US011371197B2

(12) United States Patent
McGuffie

(10) Patent No.: US 11,371,197 B2
(45) Date of Patent: Jun. 28, 2022

(54) METHOD OF MARKING A LINE

(71) Applicant: FLEET US LLC, Dakota City, NE (US)

(72) Inventor: Iain Peter McGuffie, Nr. Bromyard (GB)

(73) Assignee: FLEET US LLC, Dakota City, NE (US)

( * ) Notice: Subject to any disclaimer, the term of this patent is extended or adjusted under 35 U.S.C. 154(b) by 181 days.

(21) Appl. No.: 14/392,007

(22) PCT Filed: Jul. 15, 2013

(86) PCT No.: PCT/IB2013/055809

§ 371 (c)(1),
(2) Date: Jan. 13, 2015

(87) PCT Pub. No.: WO2014/013415

PCT Pub. Date: Jan. 23, 2014

(65) Prior Publication Data

US 2016/0002868 A1 Jan. 7, 2016

(30) Foreign Application Priority Data

Jul. 16, 2012 (GB) ..... 1212621.5

(51) Int. Cl.

| | |
|---|---|
| ***E01C 23/16*** | (2006.01) |
| ***E01C 23/20*** | (2006.01) |
| ***A63C 19/06*** | (2006.01) |

(52) U.S. Cl.

CPC ..... *E01C 23/163* (2013.01); *A63C 19/065* (2013.01); *E01C 23/203* (2013.01); *A63C 2019/067* (2013.01)

(58) Field of Classification Search

CPC ..... E01C 23/16; E01C 23/163; E01C 23/166; E01C 23/18; E01C 23/20; E01C 23/203; E01C 23/206; E01C 23/22; E01C 23/222; E01C 23/225; E01C 23/227

See application file for complete search history.

(56) References Cited

U.S. PATENT DOCUMENTS

| | | | | |
|---|---|---|---|---|
| 8,467,968 | B1 * | 6/2013 | Dolinar ..... | G01C 15/04 701/439 |
| 2004/0057795 | A1 | 3/2004 | Mayfield et al. | |
| 2007/0059098 | A1 * | 3/2007 | Mayfield ..... | A63C 19/06 404/84.5 |
| 2009/0010712 | A1 | 1/2009 | Kipfer et al. | |
| 2009/0114738 | A1 | 5/2009 | Annese et al. | |
| 2012/0101680 | A1 | 4/2012 | Trepagnier et al. | |
| 2012/0219699 | A1 * | 8/2012 | Pettersson ..... | B05B 12/122 427/8 |

* cited by examiner

*Primary Examiner* — Dah-Wei D. Yuan
*Assistant Examiner* — Nga Leung V Law
(74) *Attorney, Agent, or Firm* — US IP Attorneys, P.C.; Timothy Marc Shropshire

(57) ABSTRACT

A method of marking a line includes providing a line marking apparatus including a body (21), a line marking head (29) movable relative to the body, and a positioning system (35, 37, 41, 43) for determining a geographical location of the line marking head. In addition, a mathematical model is provided for a line to be marked by the line marking head, the model being cumulatively updated in response to a position fix (61) obtained by the positioning system. The position of the line marking head is adjusted relative to the body in dependence upon the mathematical model.

8 Claims, 3 Drawing Sheets

METHOD OF MARKING A LINE

This invention relates to a method of marking a line on a surface, such as a line for a sports pitch, a line on a road, or a line on a car-park or an airfield.

It is known to use a positioning system, such as differential GPS, IMU (inertial measurement unit) or a laser-based system to position a line marking head of a line marking apparatus in a desired geographical location for marking a portion of a line, such as a straight line or a curved line.

The line marking head may be mounted on a carriage so as to be laterally displaceable. In this way, minor errors of direction can be corrected by movement of the line marking head laterally along the carriage, while an operator or automatic control system can react to lateral movement of the line marking head and adjust the direction of the line marking apparatus to bring the line marking head back towards a median position midway between the lateral ends of the carriage.

Differential GPS, for example, determines the geographical location of the line marking head with significant accuracy, but it is still possible for a position "fix" to be located to one side or the other of the desired line to be marked, for example by up to about 5 to 10 cm. This can result in the line being marked having, at least in part, a zig-zag appearance.

It is therefore an object of the present invention to provide a method of marking a line which overcomes, or at least ameliorates the above problem.

According to the present invention there is provided a method of marking a line comprising the steps of: providing a line marking apparatus including a body, a line marking head movable relative to the body, and a positioning system for determining a geographical location of the line marking head; providing a mathematical model for a line to be marked by the line marking head; and cumulatively updating the mathematical model in response to a position fix obtained by the positioning system, and adjusting the position of the line marking head relative to the body in dependence upon the mathematical model.

The positioning system may include a primary positioning system and a secondary positioning system. The primary positioning system may be employed initially to determine the location of the line marking head and the secondary positioning system (which may be a location or directional positioning system) being employed to update the mathematical model.

The updated mathematical model may comprise a mean line predicted by the position fixes available. In one embodiment, least squares curve fitting can be used to re-calculate the mathematical model as each further position fix provides additional data.

The method may include the additional step, prior to marking a line, of following a preliminary line corresponding to the mathematical model and cumulatively updating the mathematical model in response to a position fix obtained by the positioning system, and adjusting the position of the line marking head relative to the body in dependence upon the mathematical model without marking a line until a start point is reached.

For a better understanding of the present invention and to show more clearly how it may be carried into effect reference will now be made, by way of example, to the accompanying drawings in which.

Figure 1:
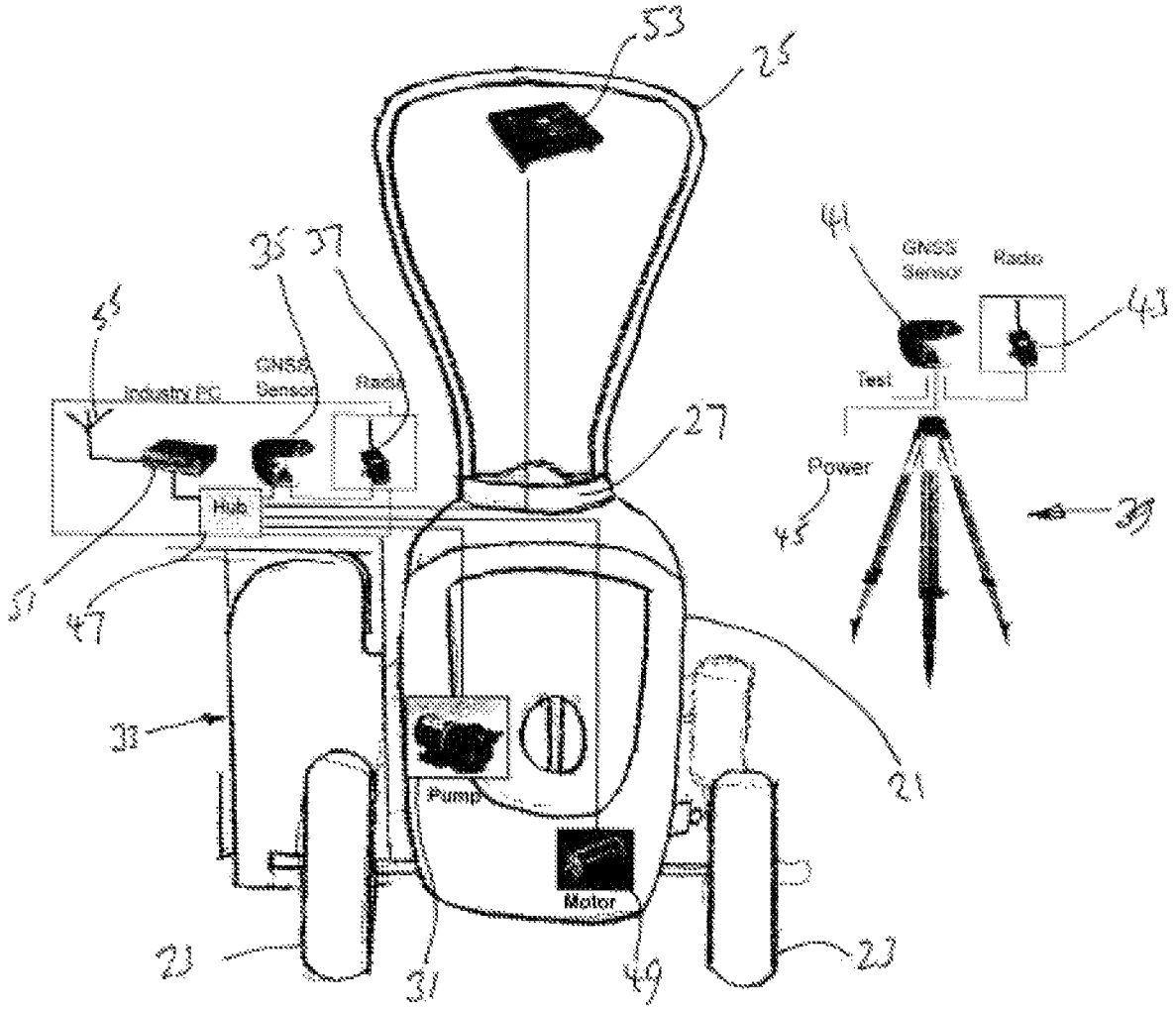
FIG. 1 is a diagrammatic front elevation of one embodiment of an apparatus for marking a line in accordance with the present invention.
Figure 2:
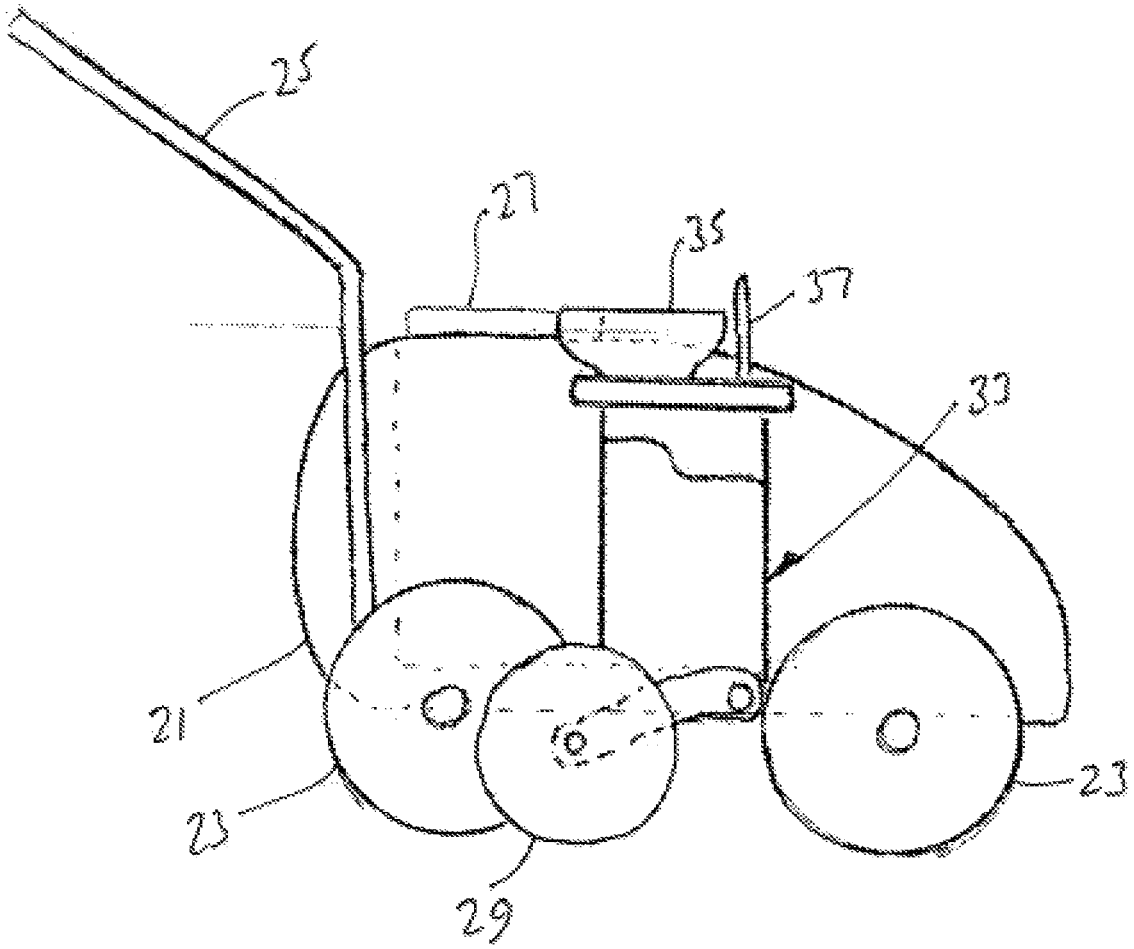
FIG. 2 is a side elevational view of the apparatus shown in FIG. 1.

FIGS. 1 and 2 diagrammatically illustrate one embodiment an apparatus for marking a line in accordance with the present invention. The apparatus comprises a body 21, which forms a chassis, provided with four wheels 23 and a handle 25 to enable a user to propel the apparatus. The body 21 is also provided with a reservoir for line marking material and having a removable cover 27. Line marking material is supplied to a line marking head 29 by way of a pump 31. The line marking head 29 is mounted on a lateral adjustment device 33 (such as that described in WO2006013386), as is a GNSS sensor 35 such that the sensor moves laterally with the line marking head. The GNSS sensor 35 is connected to a radio transceiver 37 which communicates with a stationary base station 39 which in turn incorporates a GNSS sensor 41 and a radio transceiver 43, together with a suitable power supply 45. The combination of the two GNSS devices 35 and 41 together with the two radio transceivers 37 and 43 provides a differential GPS system which in itself is well known to the skilled person.

The GNSS sensor 35 provided on the body 21 of the apparatus is connected to a network hub 47, as are the radio transceiver 37, the pump 31, and a motor 49 for controlling lateral movement of the line marking head 29 by way of the lateral adjustment device 33. A computer 51 and display 53 are also connected to the network hub 47, the display 53 showing various control and setup options as well as information relating to the line to be marked, such as distance and direction. An aerial 55 provides communication with a remote database (not shown) and permits, for example, the purchase of credit for use of the apparatus.

The apparatus shown in FIGS. 1 and 2 is used by selecting one or more lines to be marked. If desired, the computer 51 and display 53 (and optionally the apparatus itself) can be used to determine and save one or more lines to be marked together with at least one geographical datum point for the location of the lines.

In order to mark a line, the line may be downloaded to the computer 51 from the remote database and any required payment may be made. Alternatively, the location and direction of the line may be determined locally. The use of the apparatus may be logged and data returned to the remote database, for example either on completion of the task or at a later time when a suitable connection to the remote database is possible. The GNSS sensors 35 and 41 determine the location of the line marking head and guide the user to a starting location by way of the computer 51 and display 53. When marking a line, the lateral adjustment device 33 corrects for minor lateral errors in the position of the apparatus by moving the line marking head 29 laterally, such as to the right or to the left of a central position marker, but additionally or alternatively the display can indicate to the user whether movement to the left or right is required. The use of a central position marker, particularly in combination of further graduations indication the extent of movement of the line marking head from the central position marker, allows a user to redirect the line marking apparatus so as to bring the apparatus to a direction and location at which the line marking head returns towards the central position marker. The pump 31 is operated under control of the computer 51 and is turned on when a line is to be marked and off, if necessary, between marking different portions of the line. The display may indicate to the user the manner in which a line is to be marked, for example the direction in which a line is to be marked. The computer 51 advises the user, by way of the display 53, when the line has been completed.

Clearly, as an alternative to the manually propelled apparatus of FIGS. 1 and 2, the apparatus could be controlled automatically, for example by way of the computer 51. Further, alternative positioning systems can be used to provide the position fixes, including and inertial measurement unit (IMU), a laser-based system, compass or the like.

To overcome the problem associated with inaccurate position fixes, the present invention proposes not necessarily to move the line marking head to the position fix, but instead to use the position fix to determine a mean line predicted by the position fixes available. For example, a straight line, circle, curve or other graphical shape can have a mathematical model associated therewith, which mathematical model can be cumulatively updated in dependence upon the data provided by each of the position fixes in sequence. In one embodiment, least squares curve fitting can be used to re-calculate the mathematical model as each further position fix provides additional data which allows the line to be marked to be predicted with increasing accuracy as the marking operation proceeds. This technique smoothes the local inaccuracies resulting from individual position fixes and therefore eliminates, or at least substantially reduces, the tendency for the marked line to zig-zag around the ideal line. That is, the use of a mean line using all the available position fixes smoothes out any sharp inaccuracies due to one or more erroneous position fixes that would divert the line marking head from marking a smooth line. Determination of the line to be marked according to a mathematical model adjusted in dependence upon the data provided by the position fixes therefore allows a smoother line to be marked, irrespective of whether the line marking apparatus is propelled or guided by a user or whether the line marking apparatus is operated entirely automatically, for example under control of the computer 51.

In particular in the case of marking a straight line, it may be desirable not to use the primary differential GPS system for determining the direction of the line to be marked and for following that direction. As an alternative, it may be desirable to use a secondary positioning system, such as a compass, which would continue to work even when satellite communication is lost and which would not be working with the same errors as those of the differential GPS system. That is, the secondary positioning system may be a location or directional positioning system and the position fixes may therefore be geographical position fixes or directional fixes. Others of the positioning systems mentioned herein may also function in a similar manner, not requiring an external referencing system. The secondary positioning system then provides the position fixes for updating the mathematical model.

A remaining problem is that at the beginning of a line to be marked there may be a lack of position fixes to enable a smooth predicted line to be determined. This problem may be overcome by following a preliminary line which from a predetermined point at which line marking is to be commenced is collinear with the line to be marked. Such a procedure can be carried out for straight and curved lines as well as other forms of line. The preliminary line effectively follows the same course as the line to be marked so position fixes along the preliminary line can be used not only for predicting and guiding the line marking apparatus along the preliminary line, but additionally provides position fixes that enable the line to be marked to be determined with greater accuracy from the beginning of marking, thereby eliminating, or at least substantially reducing, any early divergences from the desired line to be marked.

Figure 3:
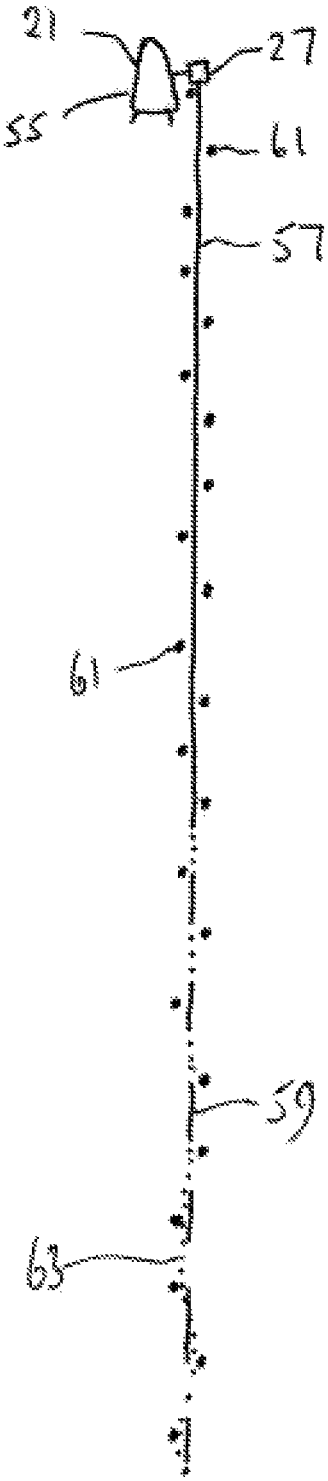
FIG. 3 is a diagrammatic plan view showing the apparatus of FIGS. 1 and 2 in use.

FIG. 3 shows the apparatus described above in relation to FIGS. 1 and 2 in use. A line marking apparatus 55 includes a body 21 and line marking head and is required to mark a line 57 shown in full. The marked line 57 is based on a predicted line 59, shown as a dashed line, which is progressively updated with each position fix 61. Before the marked line 57 is commenced, it is preceded with a pre-marked line 63, shown as a dotted line. As can be seen from the figure, the pre-marked line 63 includes initial deviation from the predicted line 59, but the deviation diminishes with distance from the start of the pre-marked line and when the line transitions to the marked line 57 there is substantially no deviation even where a position fix does not lie directly on the predicted line. The smoothing is due to the increased number of position fixes which reduce the effect of a single position fix.

I claim:

1. A method of marking a line on a ground surface using a line marking apparatus including a body, a line marking head movable relative to the body, and a positioning system, comprising the steps of:

providing a mathematical model that describes a line to be marked by the line marking head;

the line marking head marking the line, based on calculations rendered by the mathematical model, as the line marking apparatus moves over the ground surface;

the positioning system determining a succession of geographical locations, hereafter referred to as position fixes, as the line marking head marks the line;

cumulatively updating the mathematical model in response to each successive position fix obtained by the positioning system as the line marking apparatus moves over the ground surface; and adjusting the position of the line marking head relative to the body, in dependence upon the updated mathematical model, in response to each update of the mathematical model.

2. The method of claim 1, wherein the positioning system includes a primary positioning system and a secondary positioning system.

3. The method of claim 2, wherein the primary positioning system is employed initially to determine the location of the line marking head, and wherein the secondary positioning system is employed to update the mathematical model.

4. The method of claim 3, wherein the secondary positioning system comprises a location-based positional system.

5. The method of claim 3, wherein the secondary positioning system comprises a directional positioning system.

6. The method of claim 1, wherein the updated mathematical model comprises a mean line predicted by the position fixes available.

7. The method of claim 6, wherein least squares curve fitting is used to re-calculate the mathematical model as each further position fix provides additional data.

8. The method of claim 1, wherein, prior to marking a line, the method further comprises the steps of:

following a preliminary line corresponding to the mathematical model;

cumulatively updating the mathematical model in response to position fixes obtained by the positioning system while following the preliminary line; and adjusting the position of the line marking head relative to the body in dependence upon the mathematical model without marking until a start point of the line is reached.

* * * * *